US011959642B2

(12) United States Patent
Shin et al.

(10) Patent No.: US 11,959,642 B2
(45) Date of Patent: Apr. 16, 2024

(54) MICRO-MIXER AND GAS TURBINE INCLUDING SAME

(71) Applicant: DOOSAN ENERBILITY CO., LTD., Changwon (KR)

(72) Inventors: Young Jun Shin, Seongnam (KR); Han Jin Jeong, Hanam (KR); Eun Seong Cho, Busan (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/163,799

(22) Filed: Feb. 2, 2023

(65) Prior Publication Data

US 2023/0250960 A1 Aug. 10, 2023

(30) Foreign Application Priority Data

Feb. 7, 2022 (KR) ..... 10-2022-0015718

(51) Int. Cl.
*F23R 3/28* (2006.01)
*F23D 14/58* (2006.01)
*F23D 14/62* (2006.01)

(52) U.S. Cl.
CPC ..... *F23R 3/286* (2013.01); *F23D 14/58* (2013.01); *F23D 14/62* (2013.01)

(58) Field of Classification Search
CPC .. F23R 3/286; F23R 2900/00002; F23R 3/36; F23R 3/46; F23D 14/58; F23D 14/62; F02C 3/04; F02C 7/22; F05D 2220/32; F05D 2240/35
See application file for complete search history.

(56) References Cited

U.S. PATENT DOCUMENTS 3,170,504 A * 2/1965 Lanning ..... F23D 14/145 126/92 R
4,107,918 A * 8/1978 Andrew ..... F23R 3/286 60/737
4,967,561 A * 11/1990 Bruhwiler ..... F23R 3/36 60/737
6,267,585 B1 7/2001 Suttrop
8,112,999 B2 2/2012 Zuo
(Continued)

FOREIGN PATENT DOCUMENTS

JP 2003148734 A 5/2003
JP 2013-104653 A 5/2013
(Continued)

OTHER PUBLICATIONS

Database WPI Week 200024.
(Continued)

*Primary Examiner* — Gerald L Sung
*Assistant Examiner* — Rene D Ford
(74) *Attorney, Agent, or Firm* — Harvest IP Law, LLP

(57) ABSTRACT

A micro-mixer includes a plurality of fuel tubes through which air and fuel flow, a casing accommodating the plurality of fuel tubes therein, and a plurality of injection parts each formed as a pyramidal protrusion on one side of the casing and connected to a front end of the fuel tube to inject the air and the fuel, wherein each of the plurality of injection parts has an inclined injection hole formed obliquely with respect to an extension direction of the plurality of fuel tubes on at least one side of the pyramidal protrusion.

18 Claims, 10 Drawing Sheets

(56) References Cited

U.S. PATENT DOCUMENTS

| | | | | |
|---|---|---|---|---|
| 8,943,832 | B2 | 2/2015 | Uhm | |
| 9,353,950 | B2 * | 5/2016 | Uhm | F23R 3/10 |
| 9,759,425 | B2 | 9/2017 | Westmoreland | |
| 2006/0156730 | A1 * | 7/2006 | Dinu | F23D 23/00 60/737 |
| 2011/0076628 | A1 * | 3/2011 | Miura | F23R 3/343 431/12 |
| 2011/0113783 | A1 * | 5/2011 | Boardman | F23R 3/286 60/737 |
| 2011/0185703 | A1 | 8/2011 | Dodo | |
| 2012/0006030 | A1 | 1/2012 | Uhm | |
| 2014/0109582 | A1 | 4/2014 | Shershnyov | |
| 2014/0157779 | A1 | 6/2014 | Uhm | |
| 2016/0033133 | A1 | 2/2016 | Johnson | |
| 2020/0318550 | A1 * | 10/2020 | Han | F23R 3/286 |
| 2023/0250959 | A1 * | 8/2023 | Shin | F23R 3/286 60/737 |

FOREIGN PATENT DOCUMENTS

| | | | |
|---|---|---|---|
| JP | 2017172953 | A | 9/2017 |
| JP | 2020085284 | A | 6/2020 |
| JP | 2021-169913 | A | 10/2021 |
| KR | 100778716 | B1 | 11/2007 |
| KR | 101065594 | B1 | 9/2011 |
| KR | 1020190122814 | A | 10/2019 |
| KR | 20200027894 | A | 3/2020 |
| KR | 102477515 | B1 | 12/2022 |

OTHER PUBLICATIONS

Database WPI Week 201042.
Database WPI Week 201546.
EP EESR, dated Jun. 19, 2023.
The KR Notice of Allowance, dated Sep. 18, 2023.

* cited by examiner

MICRO-MIXER AND GAS TURBINE INCLUDING SAME

CROSS REFERENCE TO RELATED APPLICATION

The present application claims priority to Korean Patent Application No. 10-2022-0015718, filed on Feb. 7, 2022, the entire contents of which are incorporated herein for all purposes by this reference.

BACKGROUND OF THE INVENTION

1. Field of the Invention

The present disclosure relates to a micro-mixer and a gas turbine including the same.

2. Description of the Background Art

A turbine is a machine that obtains rotational force with an impulsive force or reaction force using a flow of compressive fluids such as steam and gas, and such turbines include a steam turbine using steam, a gas turbine using high temperature combustion gas, or the like.

A gas turbine is a combustion engine in which a mixture of air compressed by a compressor and fuel is combusted to produce a high temperature gas, which drives a turbine. The gas turbine is used to drive electric generators, aircraft, ships, trains, or the like.

The gas turbine generally includes a compressor, a combustor, and a turbine. The compressor serves to intake external air, compress the air, and transfer the compressed air to the combustor. The compressed air compressed by the compressor has a high temperature and a high pressure. The combustor serves to mix compressed air from the compressor and fuel and combust the mixture of compressed air and fuel to produce combustion gases, which are discharged to the gas turbine. The combustion gases drive turbine blades in the turbine to produce power. The power generated through the above processes is applied to a variety of fields such as generation of electricity, driving of mechanical units, etc.

Fuel, which includes gaseous fuel and liquid fuel, is injected through nozzles disposed in respective combustors. In recent years, in order to suppress the emission of carbon dioxide, use of hydrogen fuel or a fuel containing hydrogen is recommended.

However, since hydrogen has a high combustion rate, when such fuels are burned with a gas turbine combustor, flames formed in the gas turbine combustor approach and heat the structure of the gas turbine combustor, thereby degrading the reliability of the gas turbine combustor.

In order to solve this problem, combustor nozzles having multiple tubes have been proposed, but such combustor nozzles have difficulty in uniformly mixing fuel and air and have problems in the stability of gas turbine combustors exposed to high temperatures.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a micro-mixer and a gas turbine that reduce NOx emissions and prevent local heating of combustor components such as a liner or the like by improving fuel and air mixing characteristics with the provision of an injection part, an inclined injection hole, and a straight injection hole.

In an aspect of the present disclosure, there is provided a micro-mixer including: a plurality of fuel tubes through which air and fuel flow; a casing accommodating the plurality of fuel tubes therein; and a plurality of injection parts each formed as a pyramidal protrusion on one side of the casing and connected to a front end of the fuel tube to inject the air and the fuel, wherein each of the plurality of injection parts has an inclined injection hole formed obliquely with respect to an extension direction of the plurality of fuel tubes on at least one side of the pyramidal protrusion.

A diameter of the inclined injection hole may be 3 to 5 mm.

An angle formed between the extension direction of the fuel tube and an extension direction of the inclined injection hole may be 30° to 60°.

The plurality of injection parts may include a plurality of first medial injection parts adjacent to each other and a plurality of second lateral injection parts arranged around the first medial injection parts so as to be circumferentially adjacent to each other.

Each of the first medial injection parts may be provided with first inclined injection holes formed obliquely with respect to the extension direction of the fuel tube on respective sides thereof.

Each of the second lateral injection parts may be provided with second inclined injection holes formed obliquely with respect to the extension direction of the fuel tube on at least some of the respective sides, and a straight injection hole on the rest of the respective sides, the straight injection hole extending in a direction parallel to the extension direction of the fuel tube.

A diameter of the straight injection hole may be smaller than a diameter of the first inclined injection hole and a diameter of the second inclined injection hole.

The straight injection hole may be disposed on a circumferentially outermost side of the second lateral injection part.

The injection part may have a triangular pyramidal shape or a quadrangular pyramidal shape.

The injection part may have a truncated triangular pyramidal shape or a truncated quadrangular pyramidal shape.

In another aspect of the present disclosure, there is provided a gas turbine including: a compressor configured to compress air introduced from the outside, a combustor having a micro-mixer and configured to mix the compressed air compressed in the compressor and fuel and combust an air-fuel mixture, and a turbine including a plurality of turbine blades to be rotated by combustion gases combusted in the combustor, the micro-mixer including: a plurality of fuel tubes through which air and fuel flow; a casing accommodating the plurality of fuel tubes therein; and a plurality of injection parts each formed as a pyramidal protrusion on one side of the casing and connected to a front end of the fuel tube to inject the air and the fuel, wherein each of the plurality of injection parts has an inclined injection hole formed obliquely with respect to an extension direction of the plurality of fuel tubes on at least one side of the pyramidal protrusion.

A diameter of the inclined injection hole may be 3 to 5 mm.

An angle formed between the extension direction of the fuel tube and an extension direction of the inclined injection hole may be 30° to 60°.

The plurality of injection parts may include a plurality of first medial injection parts adjacent to each other and a plurality of second lateral injection parts arranged around the first medial injection parts so as to be circumferentially adjacent to each other.

Each of the first medial injection parts may be provided with first inclined injection holes formed obliquely with respect to the extension direction of the fuel tube on respective sides thereof.

Each of the second lateral injection parts may be provided with second inclined injection holes formed obliquely with respect to the extension direction of the fuel tube on at least some of the respective sides, and a straight injection hole on the rest of the respective sides, the straight injection hole extending in a direction parallel to the extension direction of the fuel tube.

A diameter of the straight injection hole may be smaller than a diameter of the first inclined injection hole and a diameter of the second inclined injection hole.

The straight injection hole may be disposed on a circumferentially outermost side of the second lateral injection part.

The injection part may have a triangular pyramidal shape or a quadrangular pyramidal shape.

The injection part may have a truncated triangular pyramidal shape or a truncated quadrangular pyramidal shape.

As described above, according to the present disclosure, the micro-mixer and the gas turbine can reduce NOx emissions and prevent local heating of combustor components such as a liner or the like by improving fuel and air mixing characteristics.

DETAILED DESCRIPTION OF THE INVENTION

Figure 1:
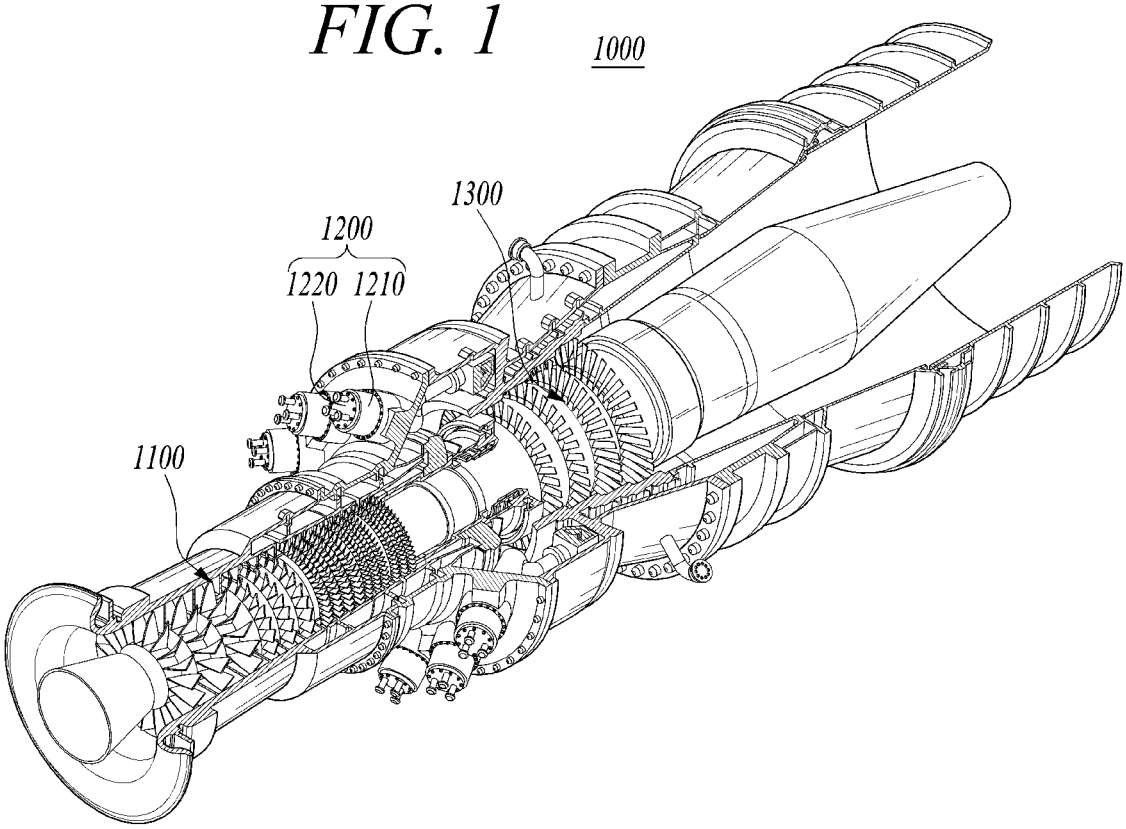
FIG. 1 is a view illustrating the interior of a gas turbine according to a first embodiment of the present disclosure.

Hereinafter, exemplary embodiments of the present disclosure will be described in detail with reference to the accompanying drawings. However, it should be noted that the present disclosure is not limited thereto, and may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the terms "comprising" or "including" specifies the presence of stated features, numbers, steps, operations, elements, parts, or combinations thereof, but does not preclude the presence or addition of one or more other features, numbers, steps, operations, elements, parts, or combinations thereof. Hereinafter, preferred embodiments of the present disclosure will be described in detail with reference to the accompanying drawings.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

Hereinafter, a gas turbine 1000 according to an embodiment of the present disclosure will be described.

Figure 2:
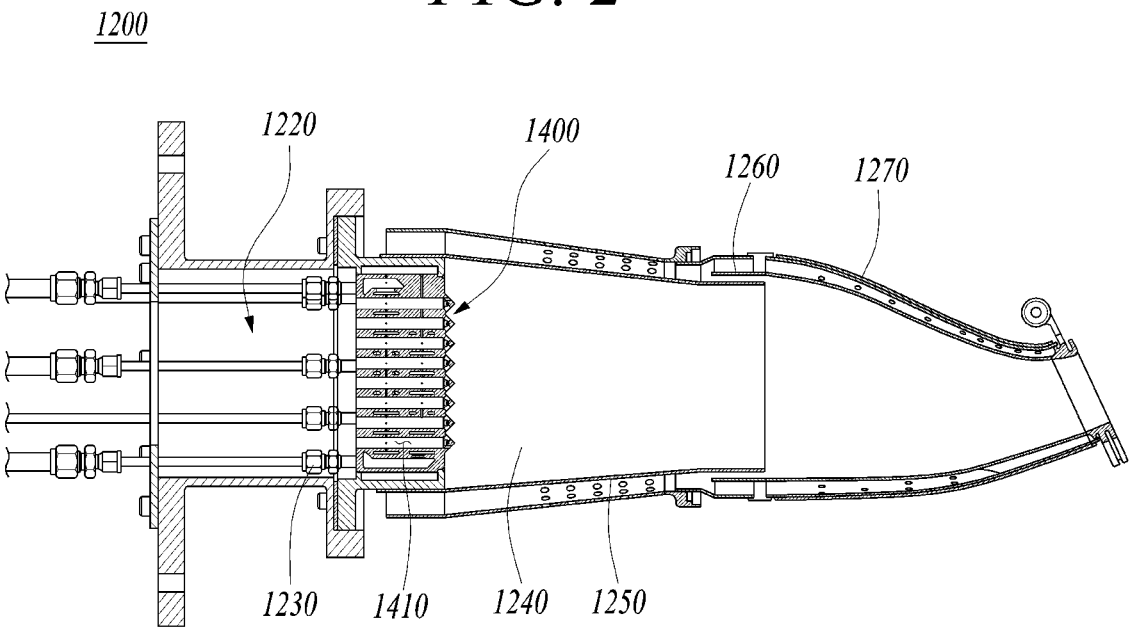
FIG. 2 is a longitudinal sectional view illustrating a combustor of FIG. 1.

FIG. 1 is a view illustrating the interior of a gas turbine according to an embodiment of the present disclosure, and FIG. 2 is a longitudinal sectional view illustrating a combustor of FIG. 1.

An ideal thermodynamic cycle of a gas turbine 1000 according to the present embodiment follows a Brayton cycle. The Brayton cycle consists of four thermodynamic processes: isentropic compression (adiabatic compression), isobaric combustion, isentropic expansion (adiabatic expansion) and isobaric heat ejection. That is, in the Brayton cycle, atmospheric air is sucked and compressed into high pressure air, mixed gas of fuel and compressed air is combusted at constant pressure to discharge heat energy, heat energy of hot expanded combustion gas is converted into kinetic energy, and exhaust gases containing remaining heat energy is discharged to the outside. That is, gases undergo four thermodynamic processes: compression, heating, expansion, and heat ejection.

As illustrated in FIG. 1, the gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIGS. 1 and 2, the compressor 1100 of the gas turbine 1000 may suck and compress external air. The compressor 1100 may serve both to supply the compressed air by compressor blades to a combustor 1200 and to supply the cooling air to a high temperature region of the gas turbine 1000. Here, since the sucked air undergoes an adiabatic compression process in the compressor 1100, the air passing through the compressor 1100 has increased pressure and temperature.

The compressor 1100 is usually designed as a centrifugal compressor or an axial compressor, and the centrifugal compressor is applied to a small-scale gas turbine, whereas a multi-stage axial compressor 1100 is applied to a large-scale gas turbine 1000 illustrated in FIG. 1 since the large-scale gas turbine 1000 is required to compress a large amount of air.

The compressor 1100 is driven using a portion of the power output from the turbine 1300. To this end, as illustrated in FIG. 1, the rotary shaft of the compressor 1100 and the rotary shaft of the turbine 1300 are directly connected. In the case of the large-scale gas turbine engine 1000, almost half of the output produced by the turbine 1300 is consumed to drive the compressor 1100. Accordingly, improving the efficiency of the compressor 1100 has a direct effect on improving the overall efficiency of the gas turbine engine 1000.

On the other hand, the combustor 1200 serves to mix the compressed air supplied from an outlet of the compressor 1100 with fuel and combust the mixture at constant pressure to produce hot combustion gases. The combustor 1200 mixes the introduced compressed air with fuel and combusts the air-fuel mixture to produce high-energy, high-temperature and high-pressure combustion gases, and increases the temperature of the combustion gases to the heat resistant limit at which the combustor and turbine parts can withstand heat through an isobaric combustion process.

A plurality of combustors 1200 may be arranged in a housing formed in the form of a cell, and each of the combustors include a burner containing a fuel injection nozzle, a combustor liner forming a combustion chamber, and a transition piece that is a connection between the combustor and the turbine.

The combustor 1200 is disposed on the downstream of the compressor 1100 such that a plurality of burners 1220 is disposed along an annular combustor casing 1210. Each burner 1220 is provided with several combustion nozzles 1230, and fuel injected from the combustion nozzles 1230 is mixed with the compressed air in an appropriate ratio suitable for combustion. The fuel injected from the fuel nozzles 1230 is mixed with the compressed air and then enters the combustion chamber 1240.

Since the combustor 1200 has the highest-temperature environment in the gas turbine engine 1000, the combustor requires appropriate cooling. Referring to FIGS. 1 and 2, a duct assembly connecting the burner 1220 and the turbine 1300 so that a high temperature combustion gas flows therethrough, that is, a duct assembly composed of a liner 1250 and the transition piece 1260, and a flow sleeve 1270 is provided such that the compressed air flows along an outer surface of the duct assembly to the combustion nozzle 1230, so that the duct assembly heated by a high temperature combustion gas is properly cooled.

The combustor 1200 may accommodate at least one micro-mixer 1400 for proper mixing of fuel and air.

High-temperature and high-pressure combustion gas produced by the combustor 1200 is supplied to the turbine 1300 through the duct assembly.

The turbine 1300 may include a plurality of turbine blades rotated by the combustion gas combusted in the combustor 1200. In the turbine 1300, the combustion gas adiabatically expands and provides an impact and reaction force to turbine blades radially arranged on the rotary shaft of the turbine 1300 so that thermal energy of the combustion gas is converted into a mechanical energy in the rotation of the rotary shaft. A portion of the mechanical energy obtained from the turbine 1300 is used to compress air in the compressor, and the rest is used as effective energy for driving a generator to produce power, for example.

Hereinafter, a micro-mixer 1400 according to an embodiment of the present disclosure will be described.

Figure 3:
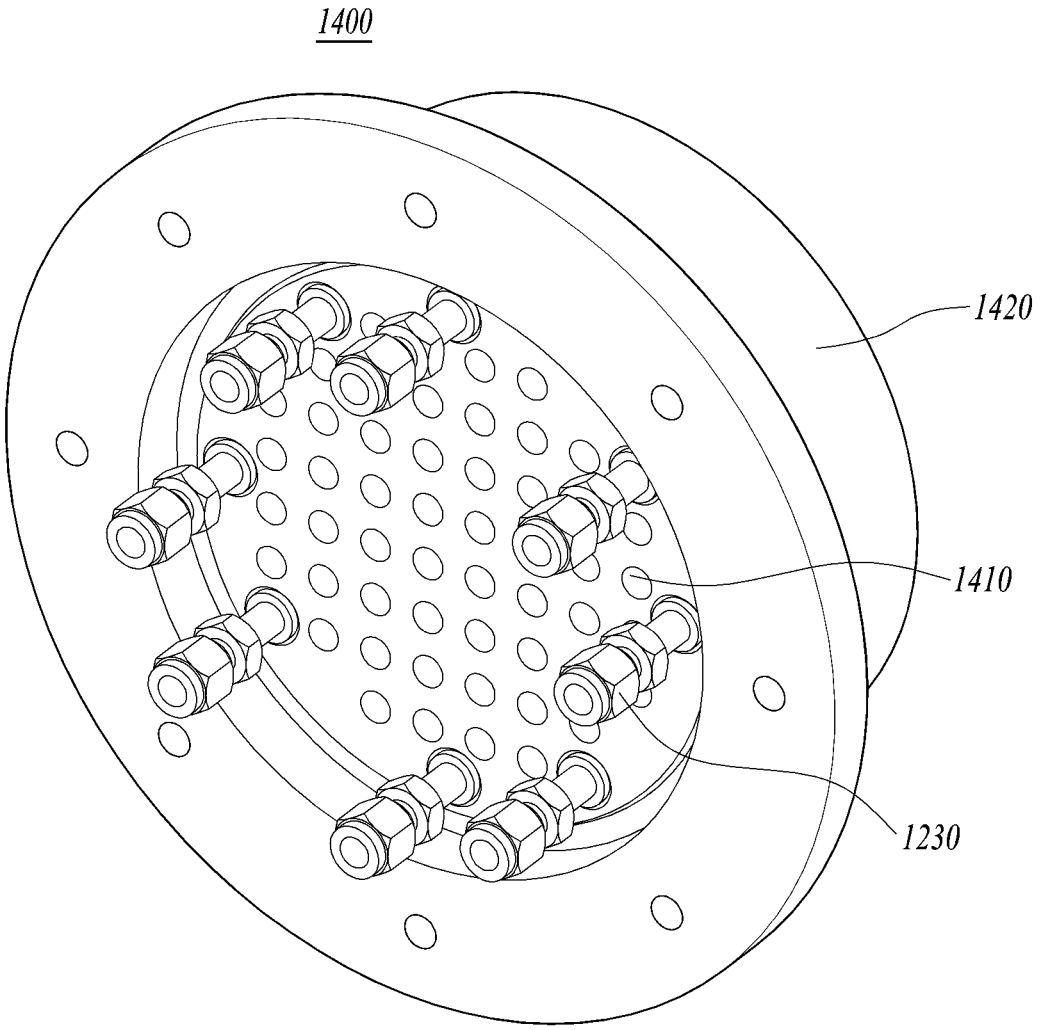
FIG. 3 is a perspective view illustrating a micro-mixer of FIG. 2.
Figure 4:
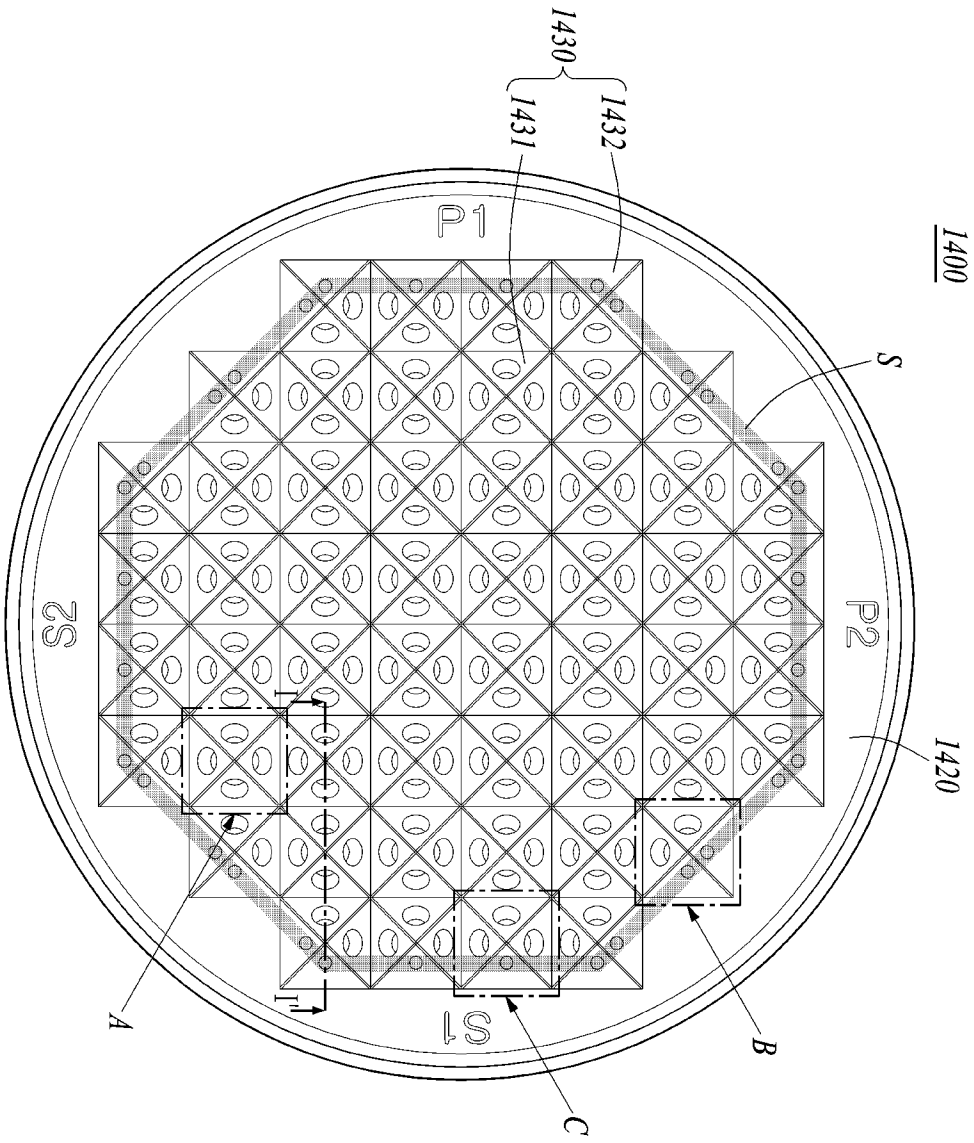
FIG. 4 is a front view illustrating the micro-mixer of FIG. 2.
Figure 5:
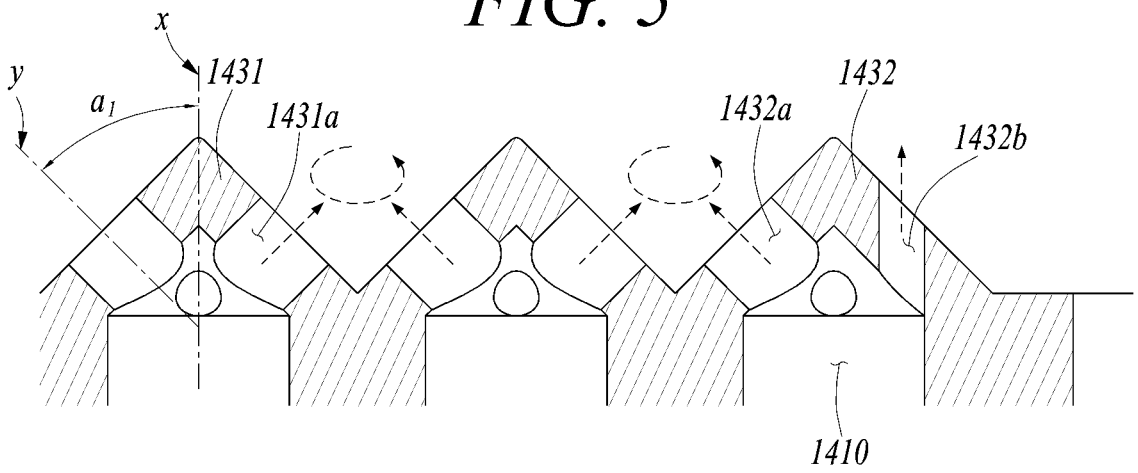
FIG. 5 is a cross-sectional view taken along line I-I' of FIG. 4.
Figure 6:
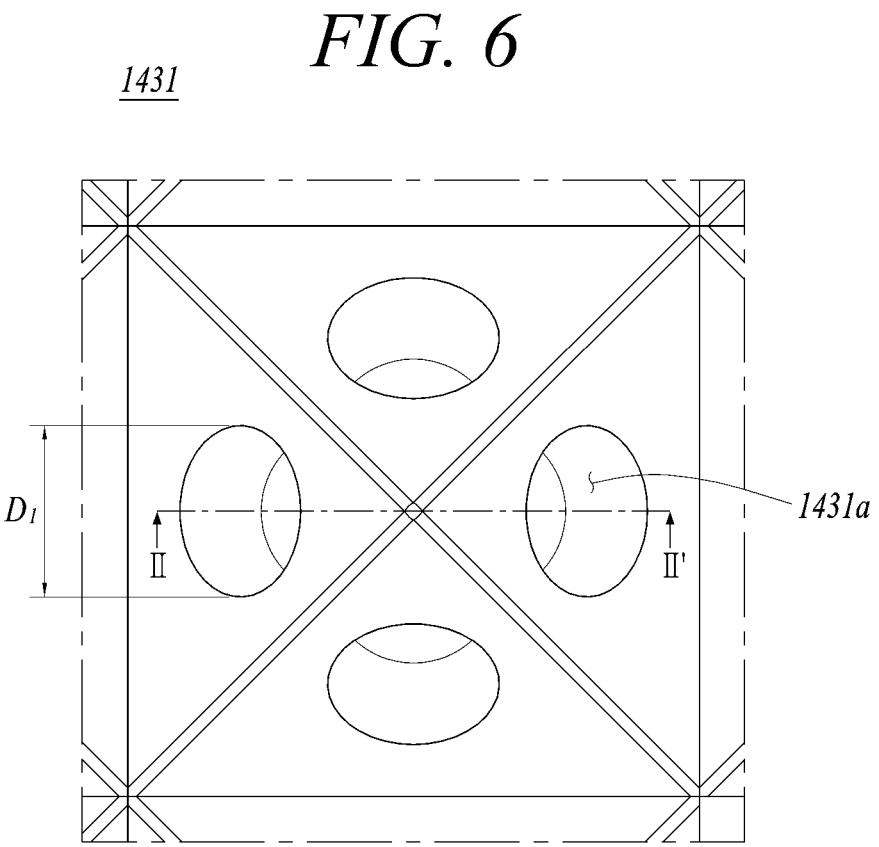
FIG. 6 is an enlarged view of section A in FIG. 4.
Figure 7:
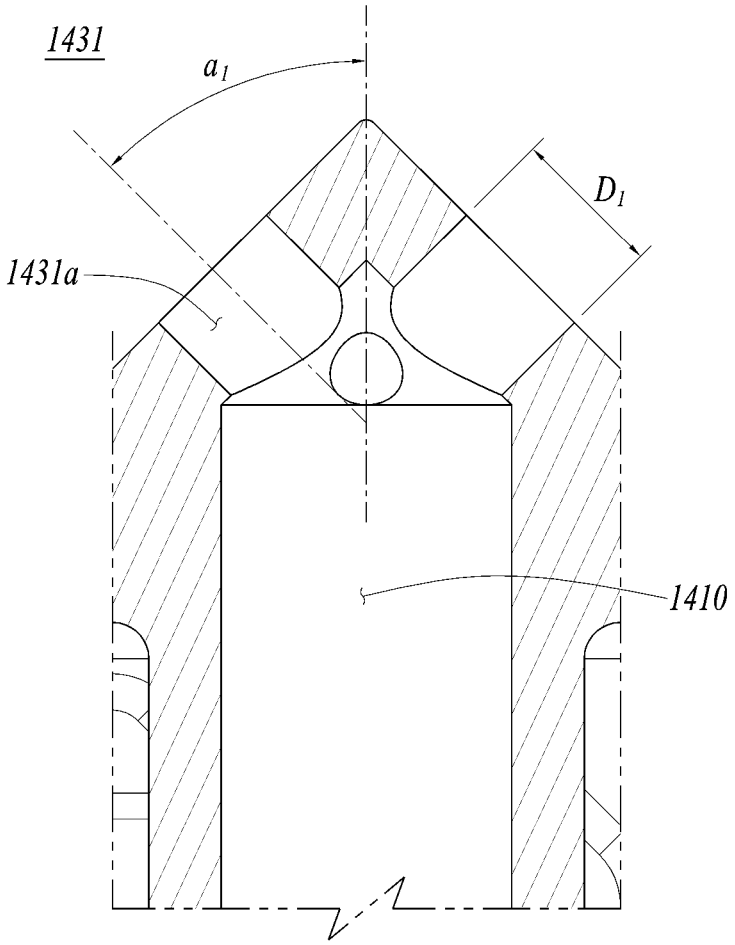
FIG. 7 is a cross-sectional view taken along line II-IF of FIG. 6.
Figure 8:
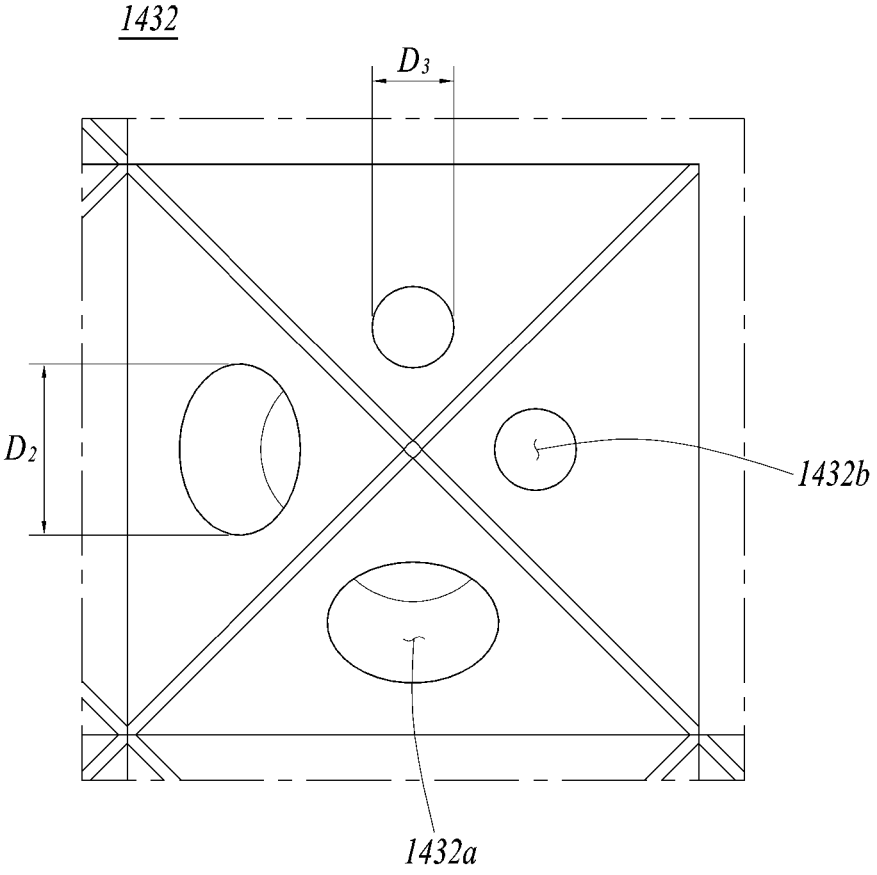
FIG. 8 is an enlarged view of section B in FIG. 4.
Figure 9:
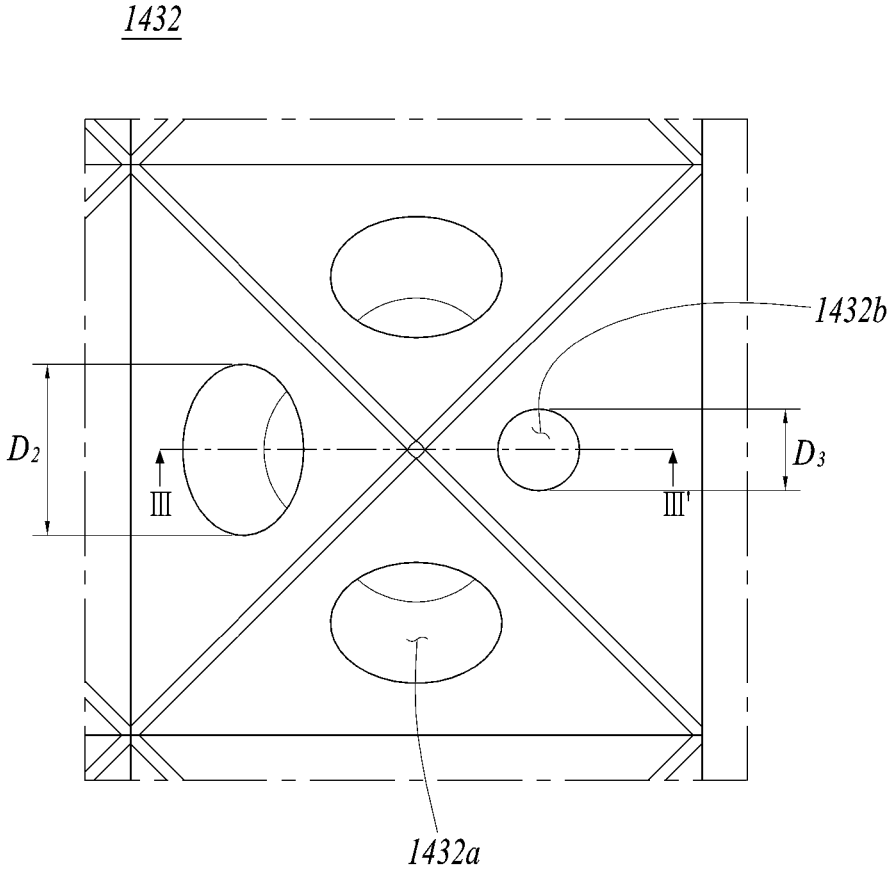
FIG. 9 is an enlarged view of section C in FIG. 4.
Figure 10:
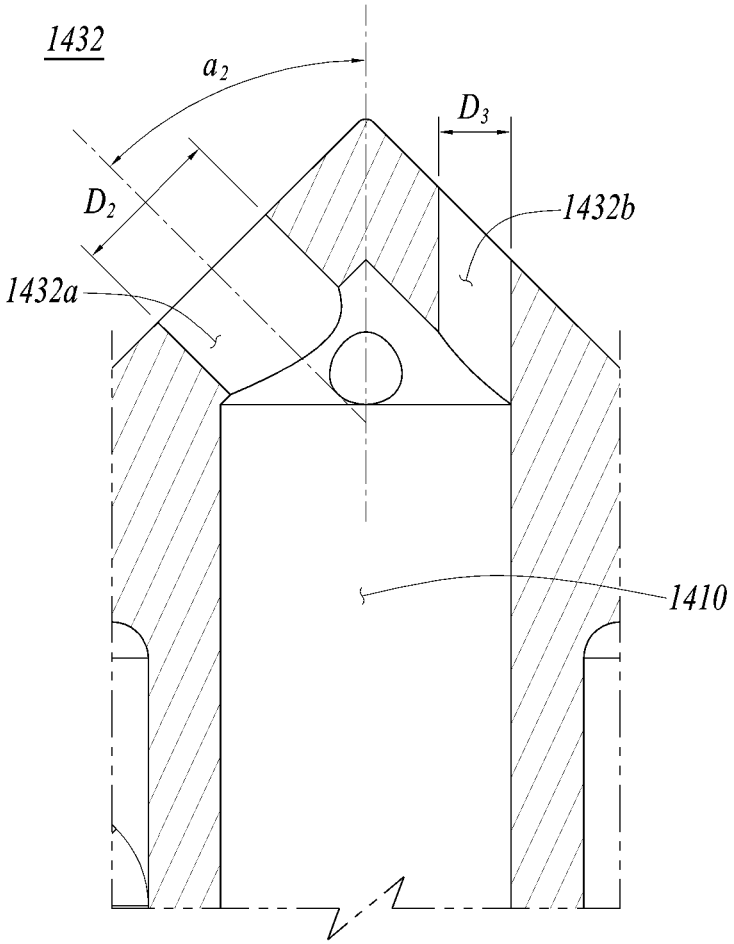
FIG. 10 is a cross-sectional view taken along line of FIG. 9.

FIG. 3 is a perspective view illustrating a micro-mixer of FIG. 2. FIG. 4 is a front view illustrating the micro-mixer of FIG. 2. FIG. 5 is a cross-sectional view taken along line I-I' of FIG. 4. FIG. 6 is an enlarged view of section A in FIG. 4. FIG. 7 is a cross-sectional view taken along line II-IF of FIG. 6. FIG. 8 is an enlarged view of section B in FIG. 4. FIG. 9 is an enlarged view of section C in FIG. 4. And, FIG. 10 is a cross-sectional view taken along line of FIG. 9.

Referring to FIGS. 3 to 10, the micro-mixer 1400 according to the embodiment of the present disclosure may include fuel tubes 1410, a casing 1420, and injection parts 1430. The micro-mixer 1400 facilitates mixing of compressed air and fuel supplied through a combustion nozzle 1230 to improve the mixing characteristics of the fuel and air, thereby reducing the amount of carbon monoxide and nitrogen oxide emissions.

Here, it can be understood by the ordinary skilled person in the art associated with this embodiment that other conventional components may be further included in the micro-mixer 1400 in addition to the components illustrated in FIGS. 3 to 10.

The fuel tube 1410 may be a passage through which air and fuel flow. A plurality of fuel tubes 1410 may be formed to form several small flames. The fuel tubes 1410 may be spaced apart from each other in the casing 1420 to be described later and may be formed to be parallel to each other. The diameter of the fuel tube 1410 may vary to finely inject fuel and air.

The casing 1420 may accommodate the plurality of fuel tubes 1410 therein. The casing 1420 may be provided on the front end thereof with injection parts to be described below so that air and fuel flowing through the fuel tubes 1410 are injected into the combustion chamber 1240 through the injection parts. The front end of the casing 1420 may be referred to as a downstream end of the casing 1420. The casing 1420 may be provided on the rear end thereof with a plurality of connection holes (not shown) to which the combustion nozzles 1230 are connected (see FIG. 3).

The casing 1420 may have a cylindrical body having an internal space in which the plurality of fuel tubes 1410 may be located. Since the casing 1420 comes into direct contact with flames generated by fuel combustion, the casing may be made of a material that has sufficient heat resistance to withstand high temperatures and sufficient durability to prevent deformation occurring due to combustion vibration. However, the shape and material of the casing 1420 are not limited thereto, and the casing may have various shapes and materials.

According to an embodiment, the injection parts 1430 may include first medial injection parts 1431 and second lateral injection parts 1432. The injection parts may be formed on one side of the casing 1420 and are connected with the front ends of the fuel tubes 1410 so that air and fuel are injected therethrough. The front ends of the fuel tubes 1410 may be referred to downstream ends of the fuel tubes 1410. Each of the injection part 1430 may protrude in a pyramidal shape from the casing 1420 toward the downstream direction. Each of the injection parts 1430 may include an inclined injection hole formed obliquely with respect to an extension direction of the fuel tube 1410 on at least one side of the pyramidal shape. The extension direction of the fuel tube 1410 may be referred to as the downstream direction, a longitudinal direction, or an axial direction.

An angle between the extension direction of the fuel tube 1410 (the direction X in FIG. 5) and the extension direction of the inclined injection hole (the direction Y in FIG. 5) may vary depending on dynamic characteristics for reducing combustion vibration.

According to an embodiment, the inclined injection hole may include a first inclined injection hole 1431*a* and a second inclined injection hole 1432*a*. In addition, the pyramidal shape of the injection part 1430 may be in a form of a pyramidal shape, a truncated pyramid shape, or a hemispherical shape in which cross-sectional areas decrease from the bottom to the top.

That is, since the injection part 1430 includes the inclined injection hole obliquely extending as a pyramidal protrusion, the fuel injected through the inclined injection hole collides with fuel injected through the surrounding inclined injection hole of an adjacent injection part to form a recirculation area (see FIG. 5).

Accordingly, adjacent injected flows of fuel may collide with each other to form the recirculation area and thus, the residence time is increased, thereby improving mixing of air and fuel. As the mixing rate of fuel and air increases, uniform combustion can be ensured so that carbon monoxide and nitrogen oxides (NOx) emissions, which are legally regulated, can be reduced.

In addition, according to an embodiment, the second lateral injection parts 1432 of the injection part 1430 may include straight injection holes 1432*b* disposed on circumferentially outermost sides thereof. The straight injection holes 1432*b* may be formed such that the flow direction of the straight injection holes 1432*b* is to be parallel to the extension direction of the fuel tube 1410 (the direction X). Since the straight injection holes 1432*b* are disposed on the circumferentially outermost sides of the second lateral injection parts, local heating of the side liner 1250 or the like and resultant thermal damage to the combustor due to high temperature can be prevented.

That is, in the outermost portion of the injection part 1430, the fuel may be injected in a straight line through the straight injection holes 1432*b* instead of the first and second inclined injection holes 1431*a* and 1432*a*, thereby preventing flame concentration on a lateral side (see FIG. 5). In addition, flames generated due to combustion of fuel injected through the first inclined injection holes 1431*a* and the second inclined injection holes 1432*a* may be prevented from reaching the lateral side of the combustion chamber 1240.

According to an embodiment, the injection part 1430 may have a triangular pyramidal shape or a quadrangular pyramidal shape. According to an embodiment, the injection part 1430 may have a truncated triangular pyramidal shape or a truncated quadrangular pyramidal shape. That is, although the injection part 1430 has a quadrangular pyramidal shape as illustrated in FIG. 4, the shape of the protrusion of the injection part 1430 may vary, according to embodiments, depending on conditions such as a required separation distance between the injection parts 1430, an angle of the injection hole, and a separation distance between the injection holes.

According to an embodiment, the first medial injection parts 1431 each may include a first inclined injection hole 1431*a*. The first medial injection parts 1431 may mean centrally positioned injection parts among the plurality of injection parts 1430. In other words, the first medial injection parts 1431 may refer to relatively centrally located injection parts from among the plurality of injection parts, other than injection parts located at peripheral positions of the plurality of injection parts. The first medial injection part 1431 may only have the first inclined injection hole 1431*a* without a straight injection hole 1432*b* described later.

The first medial injection parts 1431 may be disposed adjacent to each other. Since the first medial injection parts 1431 are disposed adjacent to each other as described above, a flow of fuel injected from the first inclined injection hole 1431*a* may collide with a flow of fuel injected from a first inclined injection hole 1431*a* of adjacent first injection part 1431 so that recirculation may occur.

The first medial injection part 1431 may include a first inclined injection hole 1431*a* obliquely formed from an extension direction of the fuel tube 1410 on each side thereof (see FIGS. 5 and 6). According to an embodiment, on the first medial injection part 1431, a first inclined injection hole may be formed on each protruding plane of the pyramid shape of the first medial injection part 1431.

The diameter D1 of the first inclined injection hole 1431*a* may be 3 to 5 mm. The diameter D1 of the first inclined injection hole may be determined depending on injection pressure and injection speed of fuel.

When the diameter D1 of the first inclined injection hole 1431*a* is less than 3 mm, the injection speed of the injected fuel may be excessively high, so recirculation may not be performed properly despite collision between the flows of injected fuel. In addition, due to an excessively high injection speed, combustion flames may come into direct contact with the liner 1250, which is located at the lateral side of the combustion chamber 1240, through a flow of fuel injected in a straight direction from the straight injection hole 1432*b*, causing a risk of damage due to local heating.

When the diameter D1 of the first inclined injection hole 1431*a* is greater than 5 mm, the injection speed of the injected fuel may be excessively low. As a result, a recirculation effect may be mitigated due to mutual collision between flows of injected fuel. Accordingly, the diameter D1 of the first inclined injection hole may be preferably 3 to 5 mm, which is an extent in which the recirculation properly occurs due to collision between flows of injected fuel and combustion flames do not come into direct contact with the lateral side of the combustion chamber 1240.

According to an embodiment, the extension direction of the first inclined injection hole 1431*a* may be inclined at a first inclination angle of 30° to 60° with respect to the extension direction of the fuel tube 1410.

When the first inclination angle a1, which is an angle defined by the extension direction of the fuel tube 1410 and the extension direction of the first inclined injection hole 1431*a*, is less than 30°, collision between flows of injected fuel may not smoothly performed, and recirculation mixing of fuel and air may not be performed properly.

When the first inclination angle a1, which is an angle defined by the extension direction of the fuel tube 1410 and the extension direction of the first inclined injection hole 1431*a*, is greater than 60°, recirculation due to collision between flows of injected fuel may occur at a position that is too close to the injection part 1430, causing a risk of damage to the injection part 1430 due to flames caused by the injected fuel. Accordingly, it is preferable that the first inclination angle a1 is 30° to 60° so that the collision between flows of injected fuel can be smoothly achieved and flames can be generated at a position that is also not too close to the injection part 1430.

According to an embodiment, the diameter D1 of the first inclined injection hole 1431*a* may be larger than that of a straight injection hole 1432*b* to be described later. According to an embodiment, since the diameter of a straight injection hole 1432*b* is smaller than the diameter D1 of the first inclined injection hole 1431*a*, the injection speed of the fuel injected from the straight injection hole 1432*b* may be faster than the injection speed of the fuel injected from the first inclined injection hole 1431*a*. If the injection speed of the fuel injected from the first inclined injection hole 1431*a* is faster than the injection speed of the fuel injected from the straight injection hole 1432*b*, then the fuel injected from the first inclined injection hole 1431*a* may flow through or flow across the fuel injected from the straight injection hole 1432*b* and, thereby, flames generated by the fuel may come into direct contact with components such as the liner 1250, which is a lateral side of the combustion chamber 1240, causing thermal damage thereto due to local heating. However, according to an embodiment of the present disclosure, since the injection speed of fuel injected from the straight injection hole 1432*b* is faster than that of fuel injected from the first inclined injection hole 1431*a*, such problem may be prevented.

According to an embodiment, the second lateral injection part 1432 may include a second inclined injection hole 1432*a* and a straight injection hole 1432*b*. The second lateral injection parts 1432 may be disposed adjacent to each other on the circumferentially outermost side of the injection parts 1430. In other words, the second lateral injection parts 1432 may be disposed at peripheral positions at the downstream end of the casing 1420 when the casing 1420 is viewed from the downstream end of the micro-mixer 1400, such that the second lateral injection parts 1432 generally surround the first lateral injection parts 1431. Since the second lateral injection parts 1432 each having the straight injection hole are disposed adjacent to each other on the circumferentially outermost side of the injection parts 1430, flames by fuel combustion may be prevented from coming into contact with the lateral side of the combustion chamber 1240.

The second inclined injection hole 1432*a* may be formed on at least some sides of the pyramid shape of the second lateral injection parts 1432 so as to be inclined with respect to the extension direction of the fuel tube 1410 (see FIGS. 8 and 10).

According to an embodiment, the diameter D2 of the second inclined injection hole 1432*a* may be 3 to 5 mm. The diameter D2 of the second inclined injection hole may be determined depending on injection pressure and injection speed of fuel.

When the diameter D2 of the second inclined injection hole 1432*a* is less than 3 mm, the injection speed of the injected fuel may be excessively high, so that recirculation may not be performed properly despite collision between the flows of injected fuel. In addition, due to an excessively high injection speed, combustion flames may come into direct contact with the liner 1250, which is located at the lateral side of the combustion chamber 1240, through or across a flow of fuel injected in a straight direction from the straight injection hole 1432*b*, causing a risk of damage due to local heating.

When the diameter D2 of the second inclined injection hole 1432*a* is greater than 5 mm, the injection speed of the injected fuel may be excessively low. As a result, a recirculation effect may be mitigated due to mutual collision between flows of injected fuel. Accordingly, the diameter D2 of the second inclined injection hole may be preferably 3 to 5 mm, in which recirculation may properly occur due to collision between flows of injected fuel and direct contact of combustion flames with the lateral side of the combustion chamber 1240 may be properly prevented.

According to an embodiment, the extension direction of the second inclined injection hole 1432*a* may be inclined at a second inclination angle of 30° to 60° with respect to the extension direction of the fuel tube 1410.

The second inclination angle a2 may be defined by the extension direction of the fuel tube 1410 and the extension direction of the second inclined injection hole 1432*a*. If the second inclination angle a2 is less than 30°, collision between flows of injected fuel may not be smoothly performed, and recirculation mixing of fuel and air may not be performed properly.

When the second inclination angle a2 is greater than 60°, recirculation due to collision between flows of injected fuel may occur at a position that is too close to the injection part 1430, causing a risk of damage to the injection part 1430 due to flames caused by the injected fuel. Accordingly, it is preferable that the second inclination angle a1 is between 30° and 60° so that the collision between flows of injected fuel can be smoothly achieved and flames can be generated at a position that is also not too close to the injection part 1430.

According to an embodiment, the diameter D2 of the second inclined injection hole 1432*a* may be larger than that of the straight injection hole 1432*b* to be described later. According to an embodiment, since the diameter of a straight injection hole 1432*b* is smaller than the diameter D2 of the second inclined injection hole 1432*a*, the injection speed of the fuel injected from the straight injection hole 1432*b* may be faster than the injection speed of the fuel injected from the second inclined injection hole 1432*a*. If the injection speed of the fuel injected from the second inclined injection hole 1432*a* is faster than the injection speed of the fuel injected from the straight injection hole 1432*b*, then the fuel injected from the second inclined injection hole 1432*a* may flow through or flow across the fuel flow injected from the straight injection hole 1432*b* and, thereby, flames generated by the fuel may come into direct contact with components such as the liner 1250, which is a lateral side of the combustion chamber 1240, causing thermal damage thereto due to local heating. However, according to an embodiment of the present disclosure, since the injection speed of fuel injected from the straight injection hole 1432*b* is faster than that of fuel injected from the second inclined injection hole 1432*a*, such problem may be prevented.

The straight injection hole 1432*b* may be formed on the other side of the respective sides of the second lateral injection part 1432 of the injection part 1430 where the second inclined injection hole 1432*a* is formed, so as to extend in a direction parallel to the extension direction of the fuel tube 1410 (see FIGS. 8 and 10).

The diameter D3 of the straight injection hole 1432*b* may be smaller than the diameters D1 and D2 of the first and second inclined injection holes. Since the diameter D3 of the straight injection hole 1432*b* is smaller than the diameters D1 and D2 of the first and second inclined injection holes, the injection speed of fuel injected from the straight injection hole 1432*b* may be faster than those of fuel injected from the first and second inclined injection holes. If the injection speed of the fuel injected from the first and second inclined injection holes 1431*a* and 1432*a* is faster than the injection speed of the fuel injected from the straight injection hole 1432*b*, then the fuel injected from the first and second inclined injection holes 1431*a* and 1432*a* may flow through or flow across the fuel flow injected from the straight injection hole 1432*b* and, thereby, flames generated by the fuel may come into direct contact with components such as the liner 1250, which is a lateral side of the combustion chamber 1240, causing thermal damage thereto due to local heating. However, since the diameter D3 of the straight injection hole 1432*b* is smaller than the diameters D1 and D2 of the first and second inclined injection holes, such problem may be prevented.

The straight injection holes 1432*b* may be disposed along the outermost periphery of the plurality of injection parts 1430. The straight injection holes 1432*b* may be disposed along an outermost straight injection zone S of the injection parts 1430. If the inclined injection holes are disposed in the straight injection zone S, fuel may be injected toward a sidewall of the combustion chamber 1240. Since this causes a risk of direct contact of combustion flames with the sidewall of the combustion chamber 1240, resulting in thermal damage due to local heating, it is preferred that only the straight injection holes 1432*b* are disposed in the straight injection zone S.

While the embodiments of the present disclosure have been described, it will be apparent to those skilled in the art that various modifications and variations can be made in the present disclosure through addition, change, omission, or substitution of components without departing from the spirit of the invention as set forth in the appended claims, and such modifications and changes may also be included within the scope of the present disclosure. Also, it is noted that any one feature of an embodiment of the present disclosure described in the specification may be applied to another embodiment of the present disclosure.

The invention claimed is:

1. A micro-mixer comprising:

a plurality of fuel tubes through which air and fuel flow;

a casing accommodating the plurality of fuel tubes therein; and a plurality of injection parts each formed as a pyramidal protrusion on one side of the casing and connected to a downstream end of a respective fuel tube from among the plurality of fuel tubes to inject the air and the fuel, wherein each of the plurality of injection parts has an inclined injection hole formed obliquely with respect to an extension direction of the plurality of fuel tubes on at least one side of the pyramidal protrusion.

2. The micro-mixer according to claim 1, wherein a diameter of the inclined injection hole is 3 to 5 mm.

3. The micro-mixer according to claim 1, wherein an angle defined between the extension direction of the plurality of fuel tubes and an extension direction of the inclined injection hole is 30° to 60°.

4. The micro-mixer according to claim 1, wherein the plurality of injection parts include a plurality of first medial injection parts adjacent to each other of the plurality of first medial injection parts and a plurality of second lateral injection parts arranged around the plurality of first medial injection parts to be circumferentially adjacent to each other of the plurality of second lateral injection ports.

5. The micro-mixer according to claim 4, wherein each of the plurality of first medial injection parts is provided with first inclined injection holes formed obliquely with respect to the extension direction of the plurality of fuel tubes on respective sides of the pyramidal protrusion.

6. The micro-mixer according to claim 4, wherein each of the plurality of second lateral injection parts is provided with second inclined injection holes formed obliquely with respect to the extension direction of the plurality of fuel tubes on some of respective sides of the pyramidal protrusion, and at least one straight injection hole on the rest of the respective sides of the pyramidal protrusion, the at least one straight injection hole extending in a direction parallel to the extension direction of the fuel tube.

7. The micro-mixer according to claim 6, wherein, in each of the plurality of second lateral injection parts, the at least one straight injection hole has a first diameter and the second inclined injection holes have a second diameter, the first diameter being smaller than the second diameter.

8. The micro-mixer according to claim 6, wherein, in each of the plurality of second later injection parts, the at least one straight injection hole is disposed on a radially outer side than the second inclined injection holes from a radial center of the micro-mixer when the casing is viewed from a downstream end of the rnicro-mixer.

9. The micro-mixer according to claim 1, wherein each of the plurality of injection parts, has a quadrangular pyramidal shape.

10. A gas turbine comprising:

a compressor configured to compress air introduced from the outside;

a combustor having a micro-mixer and configured to mix the compressed air compressed in the compressor and fuel and combust an air-fuel mixture; and a turbine including a plurality of turbine blades to be rotated by combustion gases combusted in the combustor, the micro-mixer comprising:

a plurality of fuel tubes through which air and fuel flow;

a casing accommodating the plurality of fuel tubes therein; and a plurality of injection parts each formed as a pyramidal protrusion on one side of the casing and connected to a downstream end of a respective fuel tube from among the plurality of fuel tubes to inject the air and the fuel, wherein each of the plurality of injection parts has an inclined injection hole formed obliquely with respect to an extension direction of the plurality of fuel tubes on at least one side of the pyramidal protrusion.

11. The gas turbine according to claim 10, wherein a diameter of the inclined injection hole is 3 to 5 mm.

12. The gas turbine according to claim 10, wherein an angle defined between the extension direction of the plurality of fuel tubes and an extension direction of the inclined injection hole is 30° to 60°.

13. The gas turbine according to claim 10, wherein the plurality of injection parts include a plurality of first medial injection parts adjacent to each other of the plurality of first medial injection parts and a plurality of second lateral injection parts arranged around the plurality of first medial injection parts to be circumferentially adjacent to each other of the plurality of second lateral injection parts.

14. The gas turbine according to claim 13, wherein each of the plurality of first medial injection parts is provided with first inclined injection holes formed obliquely with respect to the extension direction of the plurality of fuel tubes on respective sides of the pyramidal protrusion.

15. The gas turbine according to claim 13, wherein each of the plurality of second lateral injection parts is provided with second inclined injection holes formed obliquely with respect to the extension direction of the plurality of fuel tubes on some of respective sides of the pyramidal protrusion, and at least one straight injection hole on the rest of the respective sides of the pyramidal protrusion, the at least one straight injection hole extending in a direction parallel to the extension direction of the fuel tube.

16. The gas turbine according to claim 15, wherein, in each of the plurality of second lateral injection parts, the at least one straight injection hole has a first diameter and the second inclined injection holes have second diameter, the first diameter being smaller than the second diameter.

17. The gas turbine according to claim 15, wherein, in each of the plurality of second lateral injection parts, the at least one straight injection hole is disposed on a radially outer side than the second inclined injection holes from a radial center of the micro-mixer when the casing is viewed from a downstream end of the micro-mixer.

18. The gas turbine according to claim 10, wherein each of the plurality of injection parts has a quadrangular pyramidal shape.

* * * * *